US006190212B1

(12) United States Patent
Brown et al.

(10) Patent No.: US 6,190,212 B1
(45) Date of Patent: Feb. 20, 2001

(54) PLASTIC SUPPORT STRUCTURE AND ASSEMBLY FOR ELECTRICAL CONTACTS FOR A MOLDED PLUG

(75) Inventors: Donald C. Brown, Freehold; Michael Y. Shulman, Toms River, both of NJ (US)

(73) Assignee: Heyco, Inc., Toms River, NJ (US)

( * ) Notice: Under 35 U.S.C. 154(b), the term of this patent shall be extended for 0 days.

(21) Appl. No.: 08/954,285

(22) Filed: Oct. 20, 1997

Related U.S. Application Data

(63) Continuation of application No. 08/517,083, filed on Aug. 24, 1995, now abandoned.

(51) Int. Cl.[7] ..... H01R 13/405
(52) U.S. Cl. ..... 439/736; 439/106; 439/606
(58) Field of Search ..... 439/736, 106, 439/695, 606

(56) References Cited

U.S. PATENT DOCUMENTS

| | | | | |
|---|---|---|---|---|
| 3,328,504 | | 6/1967 | Hamel | 439/736 |
| 3,611,257 | | 10/1971 | Carkhuff | 439/106 |
| 4,398,785 | | 8/1983 | Hedrick | 439/736 |
| 4,790,776 | | 12/1988 | Iijima | 439/695 |
| 4,854,894 | | 8/1989 | Harrell | 439/736 |
| 4,861,288 | | 8/1989 | Friedman | 439/736 |
| 5,108,317 | | 4/1992 | Beinhaur et al. | 439/736 |
| 5,282,753 | * | 2/1994 | Su | 439/106 |
| 5,376,022 | | 12/1994 | Carr et al. | 439/106 |
| 5,378,162 | | 1/1995 | Waible | 439/587 |
| 5,411,403 | * | 5/1995 | Blanche | 439/106 |
| 5,474,459 | * | 12/1995 | Su | 439/106 |
| 5,603,638 | * | 2/1997 | Brown et al. | 439/606 |
| 5,647,751 | * | 7/1997 | Schulman et al. | 439/106 |
| 5,662,484 | * | 9/1997 | Blanche | 439/106 |

* cited by examiner

*Primary Examiner*—T. C. Patel

(57) ABSTRACT

A premold body forms an assembly to receive male conductors for molding into a plug. The plug to be used with a female receptacle outlet such as for 120 volt AC current. The body firmly holds blades or blades and a ground pin. By using the premold support the assembly may be assembled automatically, saving time and money in cycle time. The assembly may then be simultaneously crimped to more than one wire. The assembly is more reliable holding the conductors against being dislodged or having wild strands, particularly when molded into an outlet plug. The assembly saves labor and material cost and provides greater reliability over the prior art.

13 Claims, 4 Drawing Sheets

PLASTIC SUPPORT STRUCTURE AND ASSEMBLY FOR ELECTRICAL CONTACTS FOR A MOLDED PLUG

This application is a continuation of application Ser. No. 08/517,083, filed Aug. 21, 1995, now abandoned.

BACKGROUND OF THE INVENTION AND DESCRIPTION OF THE RELATED ART

The present invention is a molded plastic support usable as a premold for male contacts in an outlet plug. The support may be referred to as a bridge or male bridge since it holds male contacts in a spaced relationship.

Plugs for conventional 120 volt AC current electrical outlets usually include a pair of blades and a ground pin. The contacts are usually in a triangular relationship with a centered ground pin. In manufacture the blades and ground pin are usually crimped to individual conductor wires in a cable.

In the past wires for plugs were oftentimes machine crimped to contacts in automated systems. The wires of the cable were crimped, fed from a coil or roll on a stamping strip. The cord sets with wires crimped to the male blades and ground pin were then molded into plugs by being placed in a mold to be held in proper position.

Molding of plugs is complex. Three crimped male conductors have to be positioned in the mold for injection molding, it requires substantial labor, a substantial volume of plastic must be used in the molding and there is always the risk of wild strands.

By using the plastic support and assembly of the present invention, overmolding cycle time is reduced due to ease of loading the assembly into the mold. Overmolding compound requirement is reduced.

A less expensive overmolding compound can be used due to the plastic support retention characteristics. The plastic supports can be automatically assembled.

The plastic support allows for the crimping termination of all three contacts at once instead of the crimp termination of each of the blades and pin separately, in two different pieces of termination equipment.

The molding plastic, usually PVC, is a cost factor in the making of plugs. The labor of termination or crimping and engaging the crimped wire sets in a mold is expensive even though the crimping of the individual wires in the past was usually automated.

SUMMARY OF THE INVENTION

The present invention is a molded plastic support used in an assembly as a premold in which two flat metal male blades and/or one tubular metal male ground pin are engaged. This arrangement insures for the proper extension of the blades and/or ground pin from the front face of the plug in a molded cord set when over molded with PVC. The plastic support also provides for the proper spacing of the blades and/or a ground pin with regard to each other, both of which are specified by national standards associations.

The plastic support is cost effective because the overmolding cycle time is reduced due to ease of loading the plastic support into the mold, overmolding compound requirement is reduced, a less expensive overmolding compound can be used due to plastic support retention characteristics and plastic supports can be automatically (instead of hand) assembled.

The plastic support allows for the termination of all three contacts at once instead of terminating the blades and the pin separately in two different pieces of termination equipment.

The present invention does not have prior art problems associated with the contacts in molded plugs with high temperature, abrupt pull out and heavy weight testing, regardless of the molding compound used, as set up by national standards associations. The plastic support retains the contacts in the overmolded plastic cap rather than the contacts retaining themselves.

Blades and pins of the prior art which are overmolded without the plastic support of the present invention must be terminated separately, loaded into the production mold separately and have a greater risk of failure during testing particularly if a less expensive, softer durometer overmolding compound is used.

The plastic support of the present invention insures proper proper spacing of blades and/or a pin with regard to each other and to the pin and allows for automatic assembly where all (2 or 3) terminals are crimped at once.

The plastic support of the present invention is cost effective, reducing the cycle time required for overmolding, due to ease of engaging a loading plastic support into a mold and it reduces the plastic requirement regardless of the compound.

Once loaded with blades and/or pin terminations, automated crimping of wires from a cable to the plastic support may be done.

Basic advantages of the present invention are the speed and economy of assembly of the blades and/or pins in the plastic support, which is automatable, the ability to crimp cable wires to the male contacts in the plastic support, the ease of handling the assembly including the plastic support and the improved electrical integrity of a resulting molded plug. There is economic saving of molding plastic cost regardless of the compound used.

The present invention eliminates prior art individual crimping of wires and has the advantage of being more easily managed and saves the molding cost of the PVC plastic that is displaced by the plastic support.

Molding can be prepared in a shorter time, using less molding material.

According to the present invention, a premold assembly for a molded plastic electric outlet plug has male conductors to engage in openings in an electrical outlet female receptacle's usual spaced openings, for blades and a ground pin. The assembly has a molded plastic body with male conductors which have crimp means. There is a molded plastic body and at least two male electrical conductors, the conductors each having a first end, a body engaging portion, and a crimp end with crimp means. The plastic of the body is hard, though resilient, and has a front portion, a rear portion and at least two through openings for the conductors. The through openings are spaced apart a distance to appose the spaced openings in the female receptacle and have a span in a range between approximately 125 and 187 thousandths of an inch. The shape of the openings is selected to retain a conductor at the conductor's engaging portion. The conductors are engaged in the through openings, firmly retained in the openings, each positioned to address the openings in a female outlet receptacle.

The conductors may be blades and a round pin. The body has through openings for the conductors. The body may have more than one further opening between the front portion and the rear portion.

The through openings may have peripheral bevels on the rear portion. The blades may have strain reliefs, such as stop arms, to engage the rear portion of the body and may include a dimple to engage the front portion of the body.

The round pin may have a strain relief such as a stop arm, to engage the rear portion of the body and may have interactive means, such as a burr or D shape on the engaging portion, to engage the through hole against rotation and disengagement of the pin.

The through openings may have a span in a range between approximately 090 and 0.400 thousandths of an inch and the front portion and the rear portion of the body may define a thickness of the body in a range between approximately 0.125 and 187 thousandths of an inch.

The front portion and the rear portion of the body may also define a thickness in a range between approximately 090 and 400 thousandths of an inch.

The conductors each may have wire engaged in the crimp means and the assembly may be over molded with plastic to form a plug.

A premold assembly for a molded plastic electric outlet plug may have male conductors to engage in openings in an electrical outlet female receptacle's three spaced openings for blades and a ground pin. The assembly may have a molded plastic body with two blades and a round pin which have crimp means. The conductors each may have a first end, a body engaging portion, a stop arm and a crimp end with crimp means. The plastic of the body is hard, though resilient, and has a front portion, a rear portion and three through openings for the conductors. The through openings are spaced apart a distance to appose the spaced openings in the female outlet receptacle and have a span in a range between approximately 125 and 187 thousandths of an inch. The shape of the openings is selected to retain a conductor at the conductor's engaging portion. The conductors are engaged in the through openings, firmly retained in the openings each positioned to address the openings in the female receptacle. The body may have more than one further opening between the front portion and the rear portion. The interactive means on the engaging portion of the round pin to engage the through hole against rotation of the pin may be a burr.

Although such novel feature or features believed to be characteristic of the invention are pointed out in the claims, the invention and the manner in which it may be carried, may be further understood by reference to the description following and the accompanying drawing.

BRIEF DESCRIPTION OF THE DRAWING

Referring now to the figures in greater detail, where like reference numbers denote like parts in the various figures.

DESCRIPTION OF THE PREFERRED EMBODIMENTS

Figure 4:
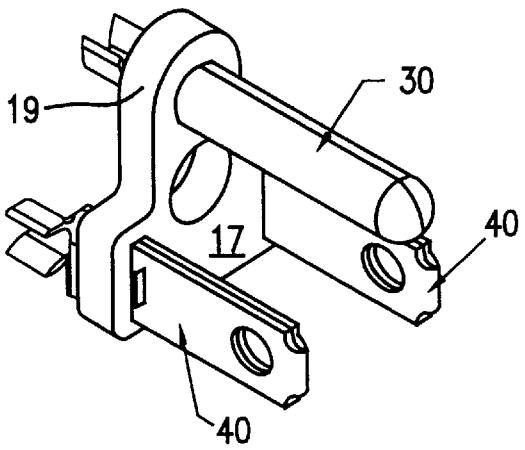
FIG. 4 is a front isometric view of FIG. 3.
Figure 2:
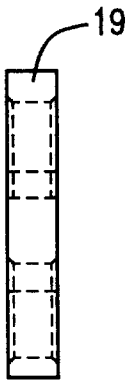
FIG. 2 is a right side elevation of FIG. 1.
Figure 1:
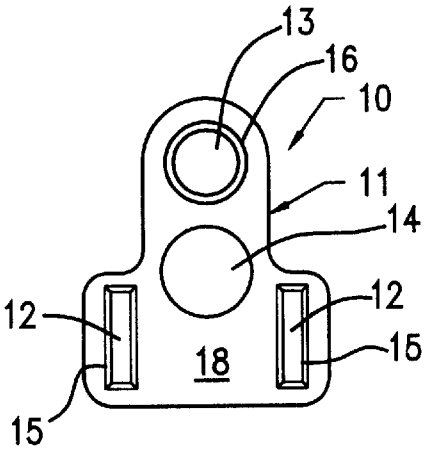
FIG. 1 is a rear elevation of the plastic support of the present invention.
Figure 3:
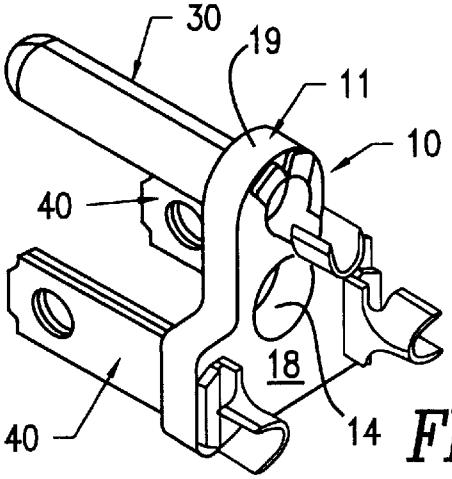
FIG. 3 is a rear isometric view of the plastic support of the present invention with two blades and a round pin engaged.

In FIGS. 1 and 2 the plastic support 10 is shown with a body 11 and a blade openings 12 and a round pin opening 13. There is a through hole 14 in the body 11. The blade openings 12 includes a small peripheral bevel 15 and the pin opening 13 has a small circumferential bevel 16. The plastic support has a front portion 17 and a rear portion 18.

As shown in FIGS. 3–6, the round pin 30 is engaged in the pin opening 13. Blades 40 are engaged in the openings 12.

Figure 13:
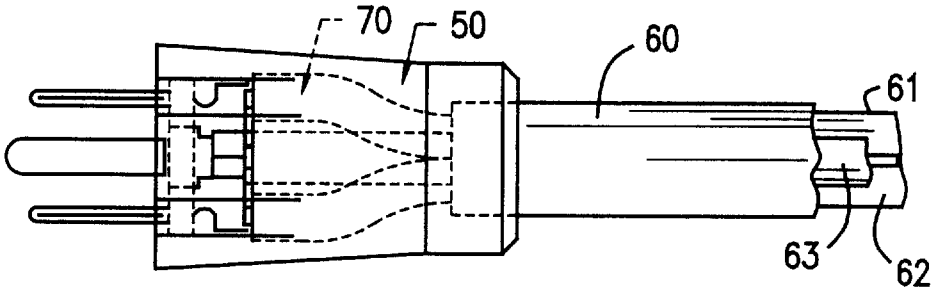
FIG. 13 is a top plan view of a plug with the plastic support assembly of the present invention.
Figure 14:
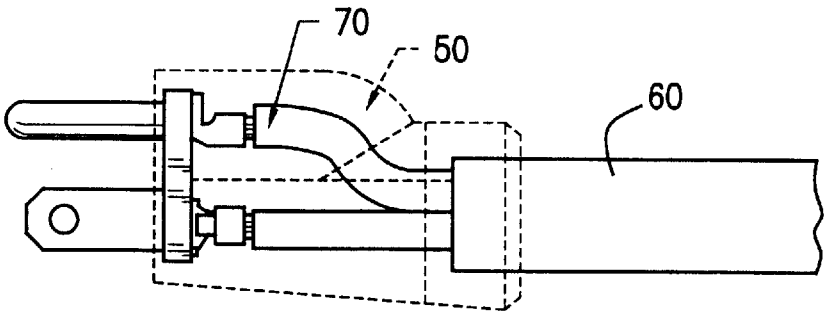
FIG. 14 is a side elevation of FIG. 13 with the plug in phantom.

As can be seen in FIGS. 13 and 14, a plug 50 is molded over the body 11 of the plastic support 10, with blades 40 engaged in the openings 12 and a round pin 30 engaged in the opening 13. The body 11 is slightly set back from the conductor extending end of the plug 50 overmolded with plastic. The wire 63 of the cable 60 is crimped at the crimp arms 34 at the crimp end 33 of the round pin 30. The wires 61 and 62, respectively, are crimped to the crimp arms 44 at the crimp end 43 of the blades 40, all in the body 11 of the plastic support 10.

Figure 9:
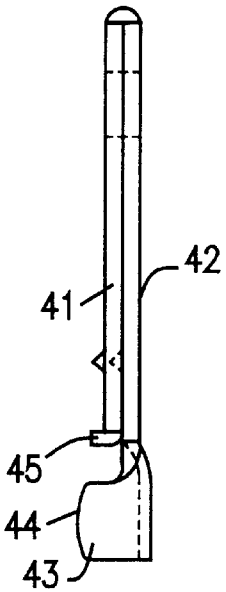
FIG. 9 is a right side elevation view of FIG. 7.
Figure 8:
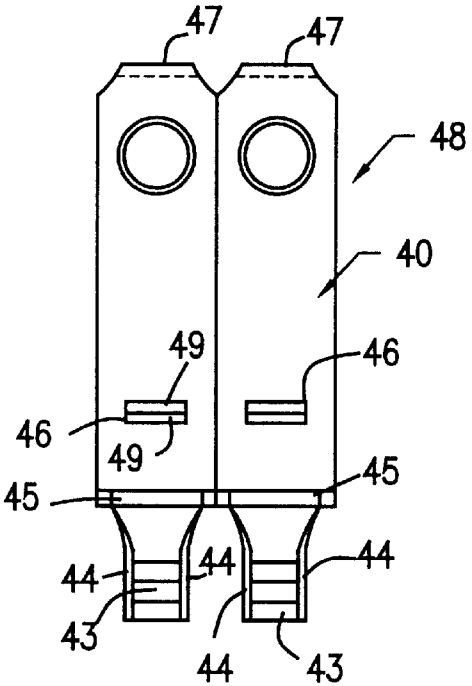
FIG. 8 is a top plan view of a stamping strip of male blades usable in the plastic support of the present invention.

As can be seen in FIGS. 8 and 9, the blades 40 are made from stamped folded metal. The sides 41, 42 are folded over from the end 47. The blade 40 has a crimp end 43. There are crimp arms 45 on the crimp end 43. Extending from the first side 41 is a strain relief 45. An elongated dimple 46 protrudes from the first side 41, spaced away from the strain relief 45. In FIG. 8, a stamping strip 48 with two blades 40 is shown.

Blades 40 on the stamping strip 48 are substantially severed, but for a small connecting portion (not shown) between the blades 40. The connecting portion enables the blades 40 to be held in coils or rolls and delivered in situ for automated procedures.

Figure 12:
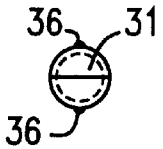
FIG. 12 is a top plan view of FIG. 11.
Figure 11:
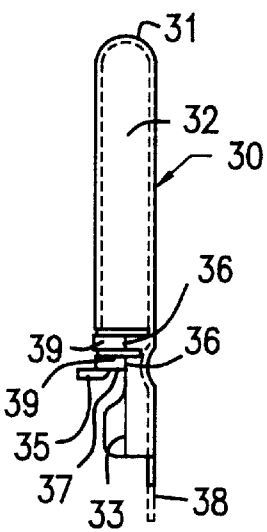
FIG. 11 is a right side elevation view of FIG. 10.
Figure 10:
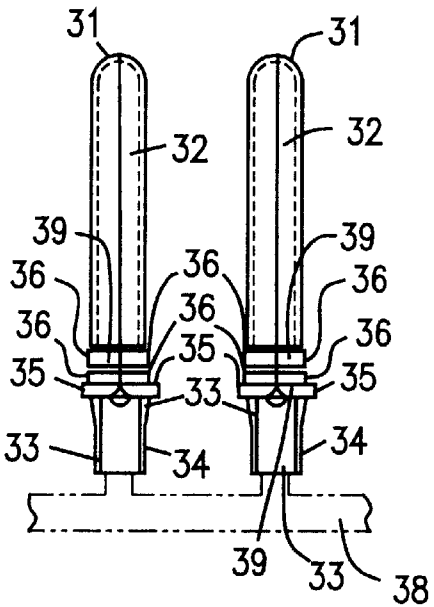
FIG. 10 is a top plan view of a stamping strip of round pins on an end strip shown in phantom, usable in the plastic support of the present invention.

As shown in FIGS. 10, 11 and 12, the round pin 30 has an end 31, a shank 32 and a crimp end 33. There are crimp arms 34 extending from the crimp end 33. Stop arms 35 extend from the base 37 of the shank 32. Each round pin 30 has burrs 36 in ridges 39 near the base 37.

Figure 15:
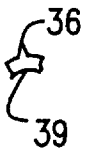
FIG. 15 is an enlarged cutaway detail at A of FIG. 11.
Figure 16:
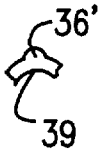
FIG. 16 is an alternate enlarged cutaway detail of FIG. 15.

FIG. 15 shows an enlarged detail at A in FIG. 11, of a burr 36 extending from the ridges 39. FIG. 16 shows an alternate embodiment, a D shaped burr 36' extending from the ridge 39.

OPERATION

As shown in FIGS. 1 and 2, the body 11 of the plastic support 10 has blade openings 12 and a pin opening 13. The blade opening 12 has a peripheral bevel 15 which serves as a guide for the insertion of blades 40. The pin opening 13 has a circumferential bevel 16 which serves as a guide to aid the insertion of a round pin 30.

As can be seen in FIGS. 3–6, the plastic support 10 is shown with the round pin 30 and two blades 40 engaged in the respective pin opening 13 and blade opening 12 in the body 11.

Once the blades 40 and round pin 30 are engaged in the body 11, the plastic support 10 is ready to have the wires 61–63 from the cable 60 crimped at the appropriate crimp end 33, 43, to the appropriate crimp arms 34, 44.

The assembly process may be done manually. With blades 40 in a stamping strip 48, as shown in FIG. 8, the blades 40 may be fed from a coil or roll (not shown) and automatically inserted into the blade openings 12 of the body 11 guided by the bevels 15 as they are severed from the stamping strip 48.

By the same token, round pins 30 on a stamping strip 38, shown in phantom in FIGS. 10, 11, may be manually or automatically assembled. The pin 30 is inserted into the opening 13 guided by the bevel 16.

Once assembled by any means, the assembled unit of plastic support 10, round pin 30 and blades 40, may then be crimped or automatically assembled by simultaneous crimping into a cord set 70, as shown in FIGS. 13, 14. The assembly is then moldable to form the plug 50.

Figure 5:
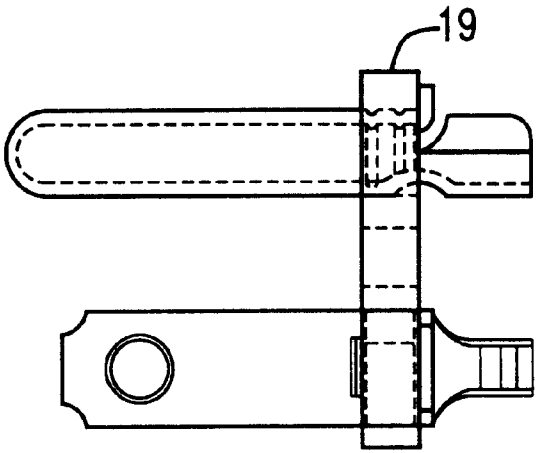
FIG. 5 is a left side elevation of FIG. 3.
Figure 7:
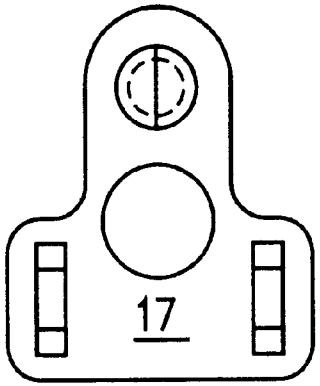
FIG. 7 is a front elevation of FIG. 5.

As can be seen in FIG. 5, the blade 40 engages the body 11 with the strain relief 45 extending from the first side 41 and abutting the body 11 on one side. The elongated dimple 46 engages the body 11 on its other side holding the blade 40 firmly against disengagement from the opening 12 in the body 11.

The stop arms 35 act as a strain relief for the round pin 30 engaged in the body 11.

Thus, after the molding process, in actual use, the blades 40 and round pin 30 are not likely to be moved or disengaged under the stress of use, testing or in being removed from the mold. The blades 40 and pin 30 are more firmly held in the body 11 of the plastic support 10 than they would be if only held crimped to the wires 61–63 in the molding plastic of the plug 50.

As can also be seen in FIG. 5, the burrs 36 engage the inside of the pin opening 13, holding the pin 30 against rotation. The holding is particularly important where units of the plastic support 10 with blades 40 and pin 30 engaged are used in an automated crimping operation. The burrs 36, thus maintain the orientation of the crimp arms 34 on the crimp end 33, to enable simultaneous crimping of all terminals with a minimum of difficulty. The burrs 36 also keep the round pin 30 from falling out of the opening 13.

Once molded into a plug 50, the molding plastic forms an immovable bond within the plug 50 between the plastic support 10 and the engaged round pin 30 and blades 40 in the body 11. The plastic, through hole 14 of the body 11 of the plastic support 10 immovably bonds the assembly of the plastic support 10, blades 40 and pin 30 with the plug 50.

Figure 6:
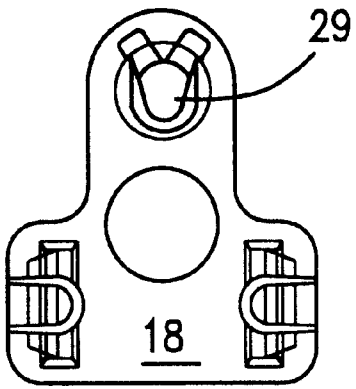
FIG. 6 is a right side elevation of FIG. 5.

The round pin 30 preferably has an end cap 29, as can be seen in FIG. 6 at the base 37, sealing the inner portion of the shank 32 during molding against plastic inflow.

The body 11 of the plastic support 10 is preferably of a hard plastic so that the blades 40 and pin 30 are securely held. The plastic support 10 has a thickness 19 defined by the front portion 17 and the rear portion 18. The thickness 19 is preferably a bit less than the space between the strain relief 45 and the elongated dimple 46. The blade 40 and body 11 of the plastic support 10 are mutually sufficiently resilient to to enable the dimple to pass through the opening 12 and then engage the front portion 17 to hold the blade 40 in the body 11. Bearing surfaces 49 on the elongated dimple facilitate its passage through the opening 12 and retention of the blade 40 at the front portion 17.

The thickness of the body 11 over its entire dimension displaces molding plastic. Such displacement may allow economies in material as hereinbefore set forth.

An important function of the thickness of the body 11 is that it can define the gripping span of the blade openings 12 and the pin opening 13.

An objective of the plastic support 10 is to provide a body 11 that can firmly hold the conductors, pin 20 and blades 40, in position to be simultaneously crimped to wires 61–63 and held in the body 11 in proper position to be molded into the plug 50 aligned to engage in the female openings (not shown) of a conventional electrical outlet female receptacle. Therefore openings 12 and 13 are preferably in intimate contact with the pin 30 and blades 40 to hold them.

The openings 12 and 13 must have a span sufficient to maintain a pin 30 or blades 40 against unwanted movement or misalignment. It is convenient for this span to be defined by the thickness of the body 11.

The span of the openings 12 and 13 must be sufficient to hold the shank 32 of the pin 30 near the base 37 against wobble once engaged and the hold the end of the first side 41 and second side 41 of the blade 40 against wobble once engaged. The span may vary depending on the nature of the plastic used for the body 11. Nylon is a good plastic for the body 11 of the support 10. It is hard and rigid with some resilient and can firmly hold a pin 30 and a blade 40.

Among the variables to be considered in selecting the span of the openings 12 and 13, which may be determined by the thickness of the body 11, are the plastic support's 10 volume, hardness, resilience, the leverage of the pin 30 or blade 40 at the openings 12 and 13 as a fulcrum, the characteristics of the plug's 50 molding plastic and its cost, the cost the metal of the blade held in span, the jostling in handling of the cord set 70 being crimped and then placed into a mold.

It is believed that span of the openings should vary from 0.090 to 0.400 of an inch. A preferred range would be between 0.125 to 0.187 of an inch. A preferred embodiment of the span is 0.140 of an inch. Although not shown, it must be remembered the molded span need not be limited by the basic thickness of the body 11. The gripping span may extend from the body 11 or be diminished by it shape such as by the bevels 15, 16.

The terms and expressions which are employed are used as terms of description; it is recognized, though, that various modifications are possible.

It is also understood the following claims are intended to cover all of the generic and specific features of the invention herein described, and all statements of the scope of the invention which, as a matter of language, might fall therebetween.

Having described certain forms of the invention in some detail, what is claimed is:

1. A premold assembly for an electrical plug, comprising:

a monolithic support member formed from insulator material and having a front surface and a rear surface, said support member having a plurality of openings extending from said front surface to said rear surface; and a plurality of electrical terminals, each of said openings having an axis and slidably receiving an associated one of said electrical terminals therein in a direction parallel to said axis, said support member continuously and rigidly surrounding each of said electrical terminals for substantially the entire thickness of said support member from said front surface to said rear surface in a position extending through said support member with a plug end extending from said support member proximate said front surface and a connector end extending from said support member proximate said rear surface, thereby permitting connection to an electrical wire, each of a pair of said plurality of electrical terminals being formed from an elongated band of metal folded at approximately mid-length at a fold, with a first portion thereof extending from said fold to a first free end and a second portion extending from said fold to a second free end, said first portion and said second portion positioned in juxtaposition to each other, said first portion having an insertion depth limiter thereon proximate said first free end, said insertion depth limiter bearing against said support member proximate said rear surface to resist insertion of a corresponding one of said pair of electrical terminals into an associated one of said openings in a direction parallel to said axis beyond said insertion depth limiter, one of said first portion and said second portion having a wire crimp distal to said fold and connectable to an electrical wire.

2. The premold assembly of claim 1, further including a withdrawal limiter on each of said pair, said withdrawal limiter extending in a direction perpendicular to the direction of extension of each of said pair and spaced from said insertion limiter to an extent that said withdrawal limiter clears said support member when each of said pair is fully inserted into said openings in said support member.

3. The premold assembly of claim 2, wherein said support member flexes to permit said withdrawal limiter to pass through an associated said opening, and relaxes when said withdrawal limiter clears said support member.

4. The premold assembly of claim 3, wherein said plurality of openings include an opening for a positive electrical terminal, a negative electrical terminal and a ground terminal.

5. The premold assembly of claim 4, wherein said support member has a vent opening therein to facilitate overmolding said support member with plastic.

6. The premold assembly of claim 5, wherein said positive terminal and said negative terminal have a blade shape and said ground terminal is a generally cylindrical pin.

7. The premold assembly of claim 6, wherein said ground terminal includes means for preventing rotation in said opening in which it is inserted.

8. The premold assembly of claim 3, wherein said withdrawal limiter is stamped into each of said pair such that when said first portion and said second portion are juxtaposed, said withdrawal limiter extends outward and a hollow is formed between said first portion and said second portion proximate to said withdrawal limiter.

9. The premold assembly of claim 8, wherein said withdrawal limiter includes a dimple formed in a surface of each of said blade-shaped terminals.

10. The premold assembly of claim 3, wherein said openings have straight, smooth, substantially parallel walls and said front surface and said rear surface are substantially parallel proximate to each of said openings.

11. The premold assembly of claim 10, wherein each of said plurality of openings has a bevel intermediate said substantially straight walls and said first surface to facilitate insertion of an associated electrical terminal.

12. The premold assembly of claim 1, wherein said insertion limiter abuts against said rear surface of said support member to limit insertion.

13. The premold assembly of claim 12, wherein said insertion depth limiter is "L" shaped with the long portion of the "L" formed from said first portion from said fold to the angle of said "L" and the short portion of the "L" extending from the angle of the "L" to said first free end, said short portion abutting against said rear surface of said support member to limit insertion, said crimp being formed on said second portion of each of said pair.

* * * * *